United States Patent [19]

Takashima

[11] Patent Number: 5,000,132

[45] Date of Patent: Mar. 19, 1991

[54] SCAVENGING SYSTEM FOR A TWO-STROKE INTERNAL COMBUSTION ENGINE

[76] Inventor: Jiro Takashima, 7203 Schiller, Houston, Tex. 77055

[21] Appl. No.: 519,926

[22] Filed: Jul. 9, 1990

[51] Int. Cl.[5] ..... F02B 75/02

[52] U.S. Cl. ..... 123/65 VA; 123/65 P; 123/671

[58] Field of Search ..... 123/671, 188 C, 193 P, 123/65 VA, 65 W, 65 P, 73 E

[56] References Cited

U.S. PATENT DOCUMENTS

| | | | |
|---|---|---|---|
| 1,342,922 | 6/1920 | Meyer | 123/65 VA |
| 1,437,929 | 12/1922 | Brockway | 123/65 VA |
| 1,556,637 | 10/1925 | Schuttler | 123/65 VA |
| 1,671,271 | 5/1928 | Blumenthal | 123/65 VA |
| 2,337,668 | 12/1943 | Larson | 123/65 W |

FOREIGN PATENT DOCUMENTS

| | | | |
|---|---|---|---|
| 112458 | 11/1925 | Switzerland | 123/73 BA |
| 8386 | of 1915 | United Kingdom | 123/65 VA |

*Primary Examiner*—David A. Okonsky
*Attorney, Agent, or Firm*—Harrison & Egbert

[57] ABSTRACT

A lengthwise scavenging system for a two stroke internal combustion engine comprising a ported cylinder, a piston, a wave formed sleeve which is attached to the piston, and a reentrant cylinder head which provide annular recess for the sleeve. The inlet ports and the exhaust ports are displaced longitudinally and latitudinally at different levels relative to the cylinder. The uppor ports are controlled by the top portion of the sleeve, and the lower by the bottom to perform lengthwise scavenging.

16 Claims, 1 Drawing Sheet

SCAVENGING SYSTEM FOR A TWO-STROKE INTERNAL COMBUSTION ENGINE

BACKGROUND OF THE INVENTION

1. Field of the Invention

The present invention relates to internal combustion engines. More particularly, the present invention relates to the use of a reentrant cylinder head for the lengthwise scavenging systems of internal combustion engines.

2. Prior Art

The well known concept of the reentrant cylinder head configuration generally consists of: the reentrant cylinder head, which provides an annular recess for the cylindrical sleeve; the cylindrical sleeve, which has openings into its wall; the cylinder, which has axially displaced ports; and the piston. The cylindrical sleeve is attached to the piston aligned to its outer margin. The ports' operation is controlled by the reciprocal movement of the sleeve, such that the port opens when the opening of the sleeve aligns with the port.

There are many previously patented reentrant cylinder head applications; the oldest one is U.S. Pat. No. 1,010,939 of G. A. Mercalf et al., the latest one is U.S. Pat. No. 2,591,619 of J. T. M. Selamann. All of those patented reentrant cylinder head applications surely have some variations, but the principal concept is the same as the one mentioned above. The prior arts of the previous inventions have some inherent drawbacks, such as the weight of the sleeve which adds to the piston and the sealing difficulty around the openings of the sleeve.

SUMMARY OF THE INVENTION

The principal object of the present invention is to attain lengthwise scavenging by the simplest method comprising: a piston with a longitudinally curved sleeve; a reentrant cylinder head which matches the shape of the sleeve; and a cylinder which has the ports displaced at different longitudinal and latitudinal levels on the cylinder wall. The distance between different functional ports depends upon the amount of amplitude and also the shape of the sleeve. It also is an object of the present invention to provide a sleeve with no openings for the ports, and to also have the sleeve control the ports' operation by its edge instead of the openings. This eliminates the special consideration of sealing for the lower openings of the sleeve whose bottom line is leveled with the piston face. These openings tend to communicate with the top ports on the cylinder, through the latitudinal passage between the sleeve rings.

Another object is to control the ports which are displaced longitudinally and latudinally at different levels by the longitudinally different leveled edge of the sleeve. Since the top edge of the sleeve is curved, every point on the edge is traveling inside the cylinder longitudinally and latitudinally at different levels at the same mean time. This makes it possible to design the shape and the location of the ports with greater flexibility. It can be designed so that when the piston comes to its end stroke, both functional ports open. The upper ports are uncovered by the top portion of the wave and the lower by the bottom to attain lengthwise scavenging.

DETAILED DESCRIPTION OF THE INVENTION

Figure 1:
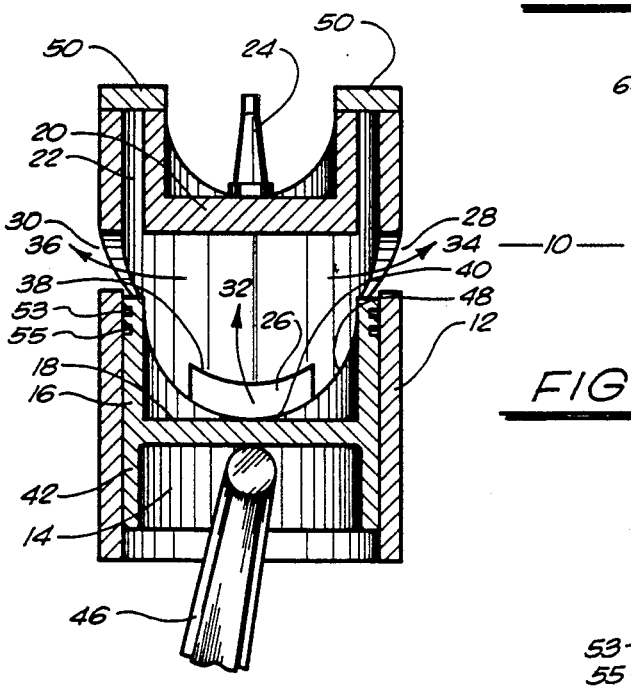
FIG. 1 is a cross-sectional view, in side elevation, of the scavenging system of the present invention showing the piston in its outermost position and showing, in particular, the flow of gases into and out of the cylinder.

Referring to FIG. 1, there is shown at 10 the scavenging system for a two-stroke internal combustion engine in accordance with the preferred embodiment of the present invention. Scavenging system 10 comprises a cylinder 12, a piston 14 slidably positioned within cylinder 12, a sleeve 16 connected to piston 14 and extending upwardly above the upper surface 18 of piston 14, a reentrant cylinder head 20 positioned interior of cylinder 12 so as to provide an annular recess 22 for sleeve 16, and a spark generator 24 positioned within cylinder 12. Cylinder 12 includes inlet port 26 and outlet ports 28 and 30. The inlet port allows the passage of the fuel/air mixture into the interior of cylinder 12. Arrow 32 illustrates the flow of gases into the cylinder 12 in the area between the upper surface 18 of piston 14 and the lower surface of reentrant cylinder head 20. The outlet ports 28 and 30 are displaced longitudinally and latitudinally from &he inlet port 26. Outlet ports 28 and 30 allow for the escape of gases from the interior of cylinder 12 as illustrated by arrows 34 and 36. The inlet port 26 and the outlet ports 28 and 30 are formed so as to extend through the body of cylinder 12. By extending through the body of cylinder 12, these ports open to the interior of the cylinder. As can be seen in FIG. 1, inlet port 26 has an upper curved edge 38 and a lower curved edge 40. In this manner, the ports are defined by an oblique circle line area, rather than conventional ports having straight right circle areas.

Piston 14 includes upper surface 18 and skirted portion 42. Piston 14 slides in close juxtaposition to the interior walls of cylinder 12. The piston has a cylindrical shape. The piston 14 is pivotally connected at 42 to the connecting rod 46. Connecting rod 46 serves to drive a system external of the scavenging system 10 in relation to the movement of the piston 14 within cylinder 12.

In the preferred embodiment of the present invention, the sleeve 16 has hyperbolic paraboloid configuration 48. This hyperbolic paraboloid configuration is illustrated in greater detail in FIG. 4. The sleeve 16 may be either integrally formed with the piston 14, rigidly affixed thereto, or extend around the exterior of piston 14. The sleeve 16 has the sleeve rings 53 and 55 near its upper edge for the purpose of sealing the area between the sleeve and the cylinder wall.

Although the preferred embodiment of the present invention describes a hyperbolic paraboloid configuration, it is believed that other configurations may also be used. For example, an angled cut extending across the sleeve could possibly also work. Various other curved configurations of the sleeve may serve the proper purpose depending on the particular application to which it is employed. As such, the configuration of the sleeve can be defined as a sleeve having an edge of varying distance from the piston. Such a description could take into account the hyperbolic paraboloid configuration of the preferred embodiment, along with the other embodiments of the present invention.

The reentrant cylinder head 20 is positioned on the interior of cylinder 12 and generally spaced from the upper surface of cylinder 12. The positioning of the reentrant cylinder head 20 provides the annular recess 22 for the receipt of the sleeve 16 during the operation of the scavenging system 10. The reentrant cylinder head 20 has a generally cylindrical cross-section. The reentrant cylinder head 20 has an interior shape that generally matches the hyperbolic paraboloid configuration of the sleeve 16. The top edge of the reentrant cylinder head 20 is sealingly attached by member 50 to the top edge of the cylinder 12. This member 50 may be integrally formed with the cylinder head 20.

In FIG. 1, it can be seen that the piston 14 is in its bottom position. When the piston 14 is in its bottom position, the inlet port 26 receives the pressurized fuel-/air mixture as delivered by conventional means. When the fuel/air mixture enters port 26, this causes the spent gases to escape through the outlet ports 28 and 30.

Figure 2:
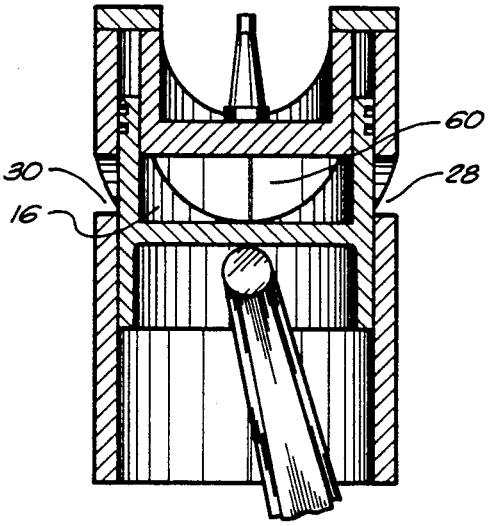
FIG. 2 is a cross-sectional view in side elevation showing the scavenging system of the present invention and showing, in particular, the piston in its position prior to firing.

Referring to FIG. 2, the scavenging system 10 of the present invention is shown in the position in which the piston 14 is in an upper position. Following the passage of the fuel/air mixture into the port 26, as illustrated in FIG. 1, the piston 14 will move upwardly within cylinder 12. As can be seen, the sleeve 16 moves into the area of the annular recess 22 between the reentrant cylinder head 20 and the upper portion of cylinder 12. The movement of the piston 14 in this manner causes a sealing of the inlet port 26 for the purpose of cutting off the inflow of the fuel/air mixture. Also, the sleeve 16 moves upwardly to sealingly close the outlet ports 28 and 30 so as to prevent the escape of the gas within the area 60. Area 60 is bounded by the interior walls of cylinder 12, the bottom of the reentrant cylinder head 20, the top surface 18 of piston 14, and the interior walls of sleeve 16. In the position illustrated in FIG. 2, the fuel/air mixture is suitably compressed into the area 60. The firing of spark generator 24 causes an ignition of the fuel/air mixture within area 60. The explosive force of this combustion causes the piston 14 to move downwardly to the position illustrated in FIG. 1. The motion created by the piston 14 causes a movement of the connecting rod 46 so as to produce movement in the system external to the scavenging system 10. This process continues through the operation of the two-stroke internal combustion engine.

Figure 3:
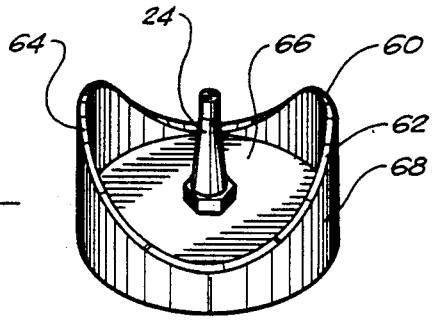
FIG. 3 is a perspective view showing the reentrant cylinder head in accordance with the preferred embodiment of the present invention.

FIG. 3 illustrates a perspective view of the reentrant cylinder head 20 of the present invention. As can be seen, the reentrant cylinder head 20 has a generally cylindrical cross-section. The upper edge 60 of the reentrant cylinder head 20 is designed with a hyperbolic paraboloid configuration. In essence, the hyperbolic paraboloid configuration has one upwardly continuous curved side 62 and another upwardly continuous curved side 64. The bottom portion of the hyperbolic paraboloid configuration 60 is in close proximity to the cylinder cap 66. Cap 66 receives the spark generator 24 in a threaded manner. The upper edge 60 of the reentrant cylinder head 20 is attached to the upper edge of the cylinder 12 by member 50 as shown in FIG. 1 and FIG. 2. The area between the outer wall 68 of reentrant cylinder head 20 and the interior wall of the cylinder 12 defines the annular recess 22 for receipt of the sleeve of the piston.

Figure 4:
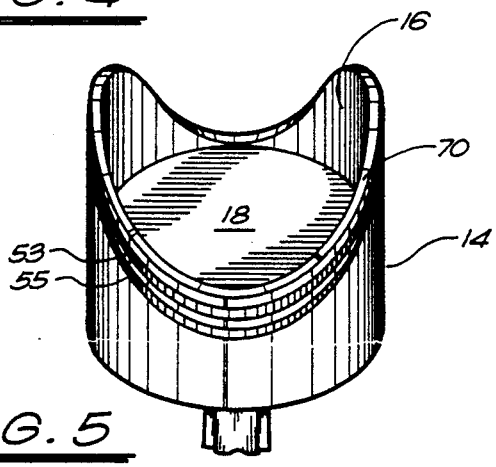
FIG. 4 is a perspective view showing the piston/-sleeve combination in accordance with the preferred embodiment of the present invention.

FIG. 4 illustrates piston 14. Sleeve 16 extends upwardly above the upper surface 18 of piston 14. The sleeve 16 has a hyperbolic paraboloid configuration of a shape similar to that of the reentrant cylinder head 20 of FIG. 3. The sleeve 16 has a lowermost portion 70 of its "wave form" shape adjacent to the top surface 18 of piston 14. The sleeve 16 has wave-shaped sleeve rings 53 and 55 near the edge. The connection rod 46 extends downwardly from the bottom of piston 14.

Figure 5:
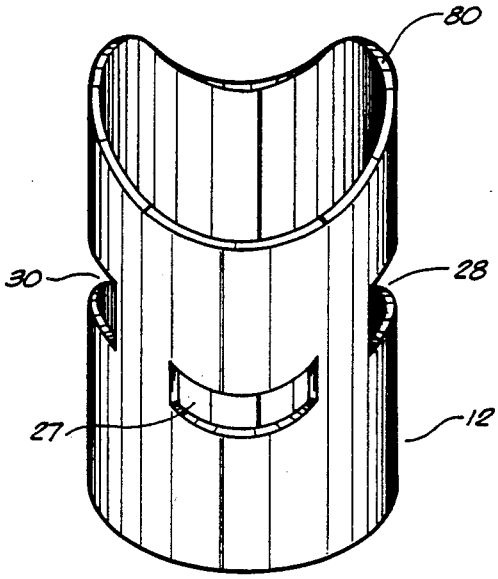
FIG. 5 is a perspective view showing the cylinder of the present invention in its preferred embodiment.

FIG. 5 illustrates the configuration of the cylinder 12. Cylinder 12 is a generally cylindrical member having a specially configured top edge 80, the inlet ports 26 and 27 and the outlet ports 28 and 30. The top edge 80 also has a hyperbolic paraboloid configuration matching that of the sleeve 16 of piston 14 and the upper edge of the reentrant cylinder head 20. Since the edge 80 has a shape that matches that of the reentrant cylinder head 20, the annular recess for the receipt of the sleeve 16 is easily formed. As stated previously, the inlet ports 26 and 27 is latitudinally and longitudinally displaced from the outlet ports 28 and 30. The positioning of the inlet ports 26 and 27 in relation to the outlet ports 28 and 30 is important considering the movement of the sleeve 16 in relation to piston 14.

The present invention offers a manner of controlling port operation by the edge of a wave-shaped sleeve. It is possible to control the ports which are longitudinally and latitudinally displaced at different levels by coordinating the shape of the sleeve with these ports at the intended time. Thus the top portion of the sleeve controls the upper ports and the bottom portion of the sleeve controls the lower ports of the cylinder at the same time.

The foregoing disclosure and description of the invention is illustrative and explanatory thereof. Various changes in the details of the illustrated apparatus may be made within the scope of the appended claims without departing from the true spirit of the invention. The present invention should only be limited by the following claims and their legal equivalents.

I claim:

1. A scavenging system for a two-stroke internal combustion engine comprising:

a cylinder having an inlet port and an outlet port;

a piston slidably positioned within said cylinder;

a sleeve fixed to said piston and extending upwardly therefrom, said sleeve having an edge of continuously varying distance from said piston; and firing means within said cylinder for actuating the movement of said piston within said cylinder.

2. The system of claim 1, further comprising:

a reentrant cylinder head positioned interior of said cylinder so as to provide an annular recess for said sleeve.

3. The system of claim 2, said reentrant cylinder head being generally cylindrical in cross-section, said reentrant cylinder head having an exterior shape generally matching the shape of said sleeve.

4. The system of claim 3, said reentrant cylinder head having a top edge connected in sealing relation to the top of said cylinder.

5. The system of claim 2, said firing means connected to said reentrant cylinder head so as to impart a spark to the interior of said piston.

6. The system of claim 1, said edge of said sleeve having a hyperbolic paraboloid configuration, said cylinder having a top edge of a configuration generally matching the hyperbolic paraboloid configuration of said sleeve.

7. The system of claim 1, said inlet port and said outlet port being displaced longitudinally and latitudinally at different levels on said cylinder.

8. The system of claim 7, said inlet port and said outlet port being coordinated relative to the position of said sleeve within said cylinder.

9. The system of claim 1, said inlet port and said outlet port having an oblique circle area, the curvature of said inlet and outlet ports corresponding to the curvature of said edge of said sleeve.

10. The system of claim 1, further comprising:

a connector rod connected to said piston for transmitting the motion of said piston external of said system.

11. A scavenging system for a two-stroke internal combustion engine comprising:

a cylinder having an inlet port and an outlet port;

a piston slidably positioned within said cylinder;

a sleeve fixed to said piston and extending upwardly from said piston, said sleeve having a curved edge in the longitudinal plane:

a reentrant cylinder head positioned interior of said cylinder so as to provide an annular recess for said sleeve; and firing means within said cylinder for actuating the movement of said piston within said cylinder.

12. The system of claim 11, said reentrant cylinder head being generally cylindrical in cross-section, said reentrant cylinder head having an exterior shape generally matching the curved configuration of the upper edge of said sleeve.

13. The system of claim 11, said sleeve having a hyperbolic paraboloid configuration, said reentrant cylinder head and said cylinder having a surface generally matching the shape of the hyperbolic paraboloid configuration of said sleeve.

14. The system of claim 11, said inlet port and said outlet port being displaced longitudinally and latitudinally at different levels on said cylinder.

15. The system of claim 11, said firing means connected to said reentrant cylinder head so as to impart a spark to the interior of said cylinder above the upper surface of said piston.

16. The system of claim 11, further comprising:

a connecting rod pivotally connected to said piston and extending outwardly from the bottom of said cylinder.

* * * * *